US005671665A

United States Patent [19]

Kayser et al.

[11] Patent Number: 5,671,665

[45] Date of Patent: Sep. 30, 1997

[54] CALENDER FOR THE TREATMENT OF A PAPER WEB AND PROCESS FOR ITS OPERATION

[75] Inventors: Franz Kayser, Geldern; Ulrich Rothfuss, Grefrath; Rolf van Haag, Kerken; Reinhard Wenzel, Krefeld; Dieter Junk, Kreuztal, all of Germany

[73] Assignee: Voith Sulzer Finishing GmbH, Krefeld, Germany

[21] Appl. No.: 612,171

[22] Filed: Mar. 7, 1996

[30] Foreign Application Priority Data

Mar. 9, 1995 [DE] Germany ..... 195 08 349.0

[51] Int. Cl.[6] ..... D21G 1/00; B30B 3/04

[52] U.S. Cl. ..... 100/38; 100/162 B; 100/163 A; 100/331

[58] Field of Search ..... 100/38, 92, 93 R, 100/93 RP, 161–167, 172

[56] References Cited

U.S. PATENT DOCUMENTS

| | | | |
|---|---|---|---|
| 2,300,994 | 11/1942 | Thiele et al. | 100/163 A |
| 2,926,600 | 3/1960 | Engelgau . | |
| 3,153,378 | 10/1964 | Nelson | 100/38 |
| 4,480,537 | 11/1984 | Agronin et al. | 100/162 B |
| 4,653,395 | 3/1987 | Verkasalo | 100/38 |
| 4,738,197 | 4/1988 | Mälkiä | 100/93 RP |
| 4,823,690 | 4/1989 | Stotz | 100/163 A |
| 5,029,521 | 7/1991 | Pav et al. | 100/163 R |
| 5,438,920 | 8/1995 | Koivukunnas et al. | 100/163 A |

FOREIGN PATENT DOCUMENTS

| | | |
|---|---|---|
| 865701 | 2/1953 | Germany . |
| 1327433 | 8/1973 | United Kingdom . |
| 2 070 090 | 9/1981 | United Kingdom . |

OTHER PUBLICATIONS

"Die neuen Superkalanderkonzepte", Voith Sulzer Papiertechnik, 1994, No. May 1994 d.

*Primary Examiner*—Stephen F. Gerrity
*Attorney, Agent, or Firm*—Darby & Darby

[57] ABSTRACT

A calender for treating a paper web includes a roller stack being loaded with a load on one end. The calender has at least two hard rollers each having a substantially smooth outer surface. The at least two hard rollers each have a device for heating a surface of the roller to a temperature of at least 100° C. The calender also includes at least two soft rollers, wherein each of the at least two soft rollers is disposed adjacent to at least one of the at least two hard rollers to form a working nip therebetween. At least one working nip has a dwell time of the paper web passing through the working nip of at least 0.1 ms. The load on the rollers produces an average compressive stress in the at least one working nip of at least 42 N/mm$^2$. An arithmetic mean of the numerical value of the surface temperature T, the dwell time t and the compressive stress p in all of the working nips satisfies the following relationship:

$$\text{a target value } Z_g=1.378-0.00356\cdot T-(0.00825-5.12\cdot 10^{-5}T)p-[0.039+(0.188-0.00112T)p\cdot e^{-0.093p}]t\cdot e^{-0.42t_r}=0.8 \text{ to } 0.9.$$

12 Claims, 2 Drawing Sheets

CALENDER FOR THE TREATMENT OF A PAPER WEB AND PROCESS FOR ITS OPERATION

BACKGROUND OF THE INVENTION

1. Field of the Invention

The present invention relates to a calender for treating a paper web. More specifically, the present invention relates to a calender that is suitable for manufacturing paper that can be used in gravure printing and a process for operating the calender. The calender includes one roller stack that can be loaded from the end and includes hard roller and soft rollers. Working nips are formed between the juncture of a hard roller and a soft roller. A changeover nip is formed by the juncture of two soft rollers. The hard roller surface, disposed adjacent to the working nip, can be heated. At least one end roller is deflection-controllable.

2. Discussion of the Related Art

Many calenders of this type are known, for example, from the 1994 brochure "Die neuen Superkalanderkonzepte" [The New Super-calender Concepts], which is published by Sulzer Papertec Company (identification number 05/94 d). These calenders are used for the final treatment of a paper web so that the web will obtain the desired degree of roughness or smoothness, gloss, thickness, bulk and the like. These calenders are installed separately from a paper machine. The soft or elastic rollers have an outer covering that is primarily made of a fibrous material. The heatable rollers have a surface temperature heated up to about 80° C. The average compressive stress in the working nips during normal operation is between 15 and 30 N/mm$^2$, while maximum values of approximately 40 N/mm$^2$ have also been applied in the lowest working nip. The rollers are arranged in a roller stack. A roller stack with 9 or 10 rollers is sufficient for paper that is to be simply finished, such as writing paper. A stack with 12 to 16 rollers is required for higher quality paper, such as paper suitable for photogravure printing, technical papers or compression papers. However, a large machine of this type is expensive and requires a great deal of space.

In addition, so-called compact calenders are known in which a heatable roller forms a nip with a deflection-controllable soft roller. Two compact calenders can be connected in series to treat both sides of a paper web. However, these calenders can only be used to manufacture paper that requires simple finishing but not high quality papers, such as a silicon based paper or paper for photogravure printing. Moreover, compact calenders require that a large amount of deformation energy, in the form of heat, be added to operate the calender. The heatable rollers, therefore, have a surface temperature ranging from 160° C. to 200° C. A large amount of heat energy is radiated that must then be exhausted using air conditioners. Because the roller diameter is larger in a compact calender (for sturdiness purposes) than the roller diameter in a supercalender, higher loads per unit of length must be applied to produce the compressive stresses for the desired finishing result. Furthermore, replacement rollers for the soft rollers are expensive because they must also be deflection-controllable.

SUMMARY OF THE INVENTION

It is an object of the present invention to provide a calender of the type described above that is smaller and less expensive to manufacture and operate but that nonetheless also affords excellent finishing results, particularly regarding photogravure printing.

The object is achieved in accordance with the preferred embodiment of the present invention in that the roller stack has only eight rollers. To increase the deformation energy supplied to the paper web, at least one working nip is provided having a dwell time of at least 0.1 ms. A heatable roller adjacent to the working nip, has a surface temperature of at least 100° C. Furthermore, the load on the rollers has an average compressive stress in the working nips of at least 42 N/mm$^2$.

The effect of the roller weight on the load per unit of length is decreased by reducing the stack height. Therefore, it is possible to have the same load per unit of length in the lowest nip while working in the uppermost intake nip with a higher load per unit of length than is used in supercalenders of the prior art. It is, therefore, sufficient to only moderately increase the deformation energy supplied, while still being able to process high-quality paper satisfactorily. For example, heat can be added at temperatures that are only slightly above the customary temperatures and, therefore, only slightly increase the heat radiation.

In addition, different forms of heat transfer media are available. As a result, the difficulties encountered at the higher temperatures, which must be used for compact calenders, are avoided. A relatively slight increase in the compressive stress is also sufficient but should be taken into account when selecting the covering material for the elastic roller. Since both factors (increased heat and increased load) can be applied simultaneously in at least one working nip, preferably the lowest working nip, positive results can be achieved when producing high-quality paper even with a rapidly running calender. Because the roller stack is not as tall as supercalenders of the prior art, lower structures are sufficient, which significantly reduces installation costs.

Preferably, the dwell time of the paper web passing through a working nip is at most 0.9 ms. A surface of the roller adjacent to the working nip is preferably designed to reach a maximum surface temperature of 150° C. The roll stack is loaded so that the average compressive stress is less than or equal to 60 N/mm$^2$. Therefore, only a moderate increase in the surface temperature and the compressive stress is actually necessary. In most cases, a surface temperature of less than 130° C. and an average compressive stress of less than 50 N/mm$^2$ are sufficient, while the preferred dwell time is between 0.2 to 0.5 ms. Preferably, these parameters apply to all or at least a majority of the working nips.

In a preferred embodiment, the upper and lower rollers are hard and are heatable. Heat energy is preferably applied to the hard rolls because these rolls can more easily be heated than soft rollers. This is especially true when the upper and lower rollers are deflection controllable, because the pressure fluid, which is used to adjust the deflection, can be heated to control the heating of these rollers.

It is particularly beneficial for the soft rollers to have an outer plastic covering. Plastic covered rollers operate significantly better than rollers which are covered with a fibrous material at increased average compressive stresses. The plastic covered rollers allow operation at a compressive stress of more than 42 N/mm$^2$. Preferably, the covering permits a compressive stress in the working nip of up to approximately 60 N/mm$^2$.

The covering is preferably made of fiber-reinforced epoxy resin. A plastic of this type, with the characteristics specified above, is commercially available, for example, under the brand name "TopTec 4" from the Scapa Kern Company, of Wimpassing, Austria.

In an alternate embodiment of the present invention, the roller stack is arranged in-line with a paper or coating machine. The paper web is thus at a relatively high temperature at the intake nip of the calender, for example 60° C., and therefore, the web only requires a slight addition of heat to provide sufficient deformation. Plastic coverings, which are already desirable because of the higher compressive stress they can withstand, are particularly suitable for an in-line operation of this type because, in contrast to coverings made of fibrous material, they are significantly less susceptible to marking. Therefore, plastic coverings rarely need to be removed and ground.

It is preferable for each roller to be driven independently of the other rollers. Therefore, the paper web can be pulled in while the calender is operating because all rollers can be brought to the same speed before the nips are closed.

It is also preferable that the roller stack be covered by a protective hood that reduces heat radiation. A protective hood of this type reduces heat radiation so that the manufacturing facility is not heated excessively, which results in a savings in air conditioning expenses. Conversely, the temperature inside the hood will be maintained at a higher level than in conventional calenders so that the addition of heat through the heating device can be minimized.

A process for operating a calender described above involves selecting the means of the numerical values of the surface temperature T [in °C.], the average compressive stress σ [in N/mm$^2$], and the dwell time t [in ms] of all working nips such that the following relationship (I) applies to a target value Zg:

$$Zg=1.378-0.00356\cdot T-(0.00825-5.12\cdot 10^{-5}T)\sigma-[0.039+(0.188-0.00112T)\sigma\cdot e^{-0.093\sigma}]t\cdot e^{-0.42t}=0.8 \text{ to } 0.9$$

Because the dwell time t in a given calender can be varied only to a slight extent, the surface temperature T and the average compressive stress σ are primarily modified to optimize the above parameters.

DETAILED DESCRIPTION OF THE INVENTION

Figure 1:
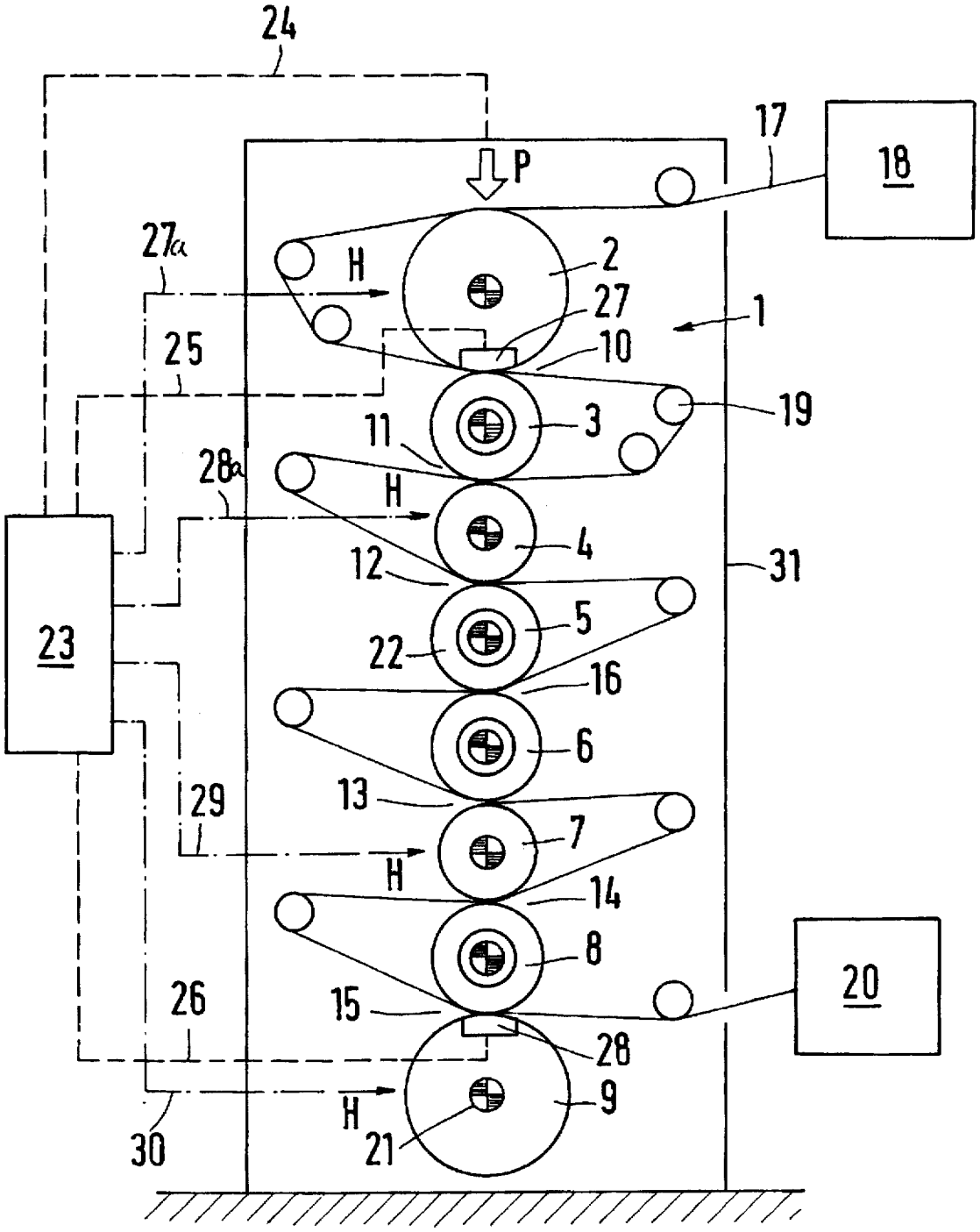
FIG. 1 is a schematic representation of a preferred calender in accordance with the present invention

Referring now to FIG. 1, the preferred calender 1 has one roller stack comprised of eight rollers, specifically, a heatable deflection-controllable hard upper roller 2, a soft roller 3, a heatable hard roller 4, a soft roller 5, a soft roller 6, a heatable hard roller 7, a soft roller 8, and a heatable, deflection-controllable hard lower roller 9. This configuration produces six working nips 10–15, each of which is delimited by one hard roller and one soft roller, and a changeover nip 16 which is delimited by two soft rollers 5 and 6.

A paper web 17 is fed out of a paper machine or a coating machine 18, passes under the control of guide rollers 19, through the working nips 10–12, the changeover nip 16, and the working nips 13–15 after which the web is wound onto a winding device 20. In the top three working nips 10–12, the paper web 17 has one of its sides contacting against the hard rollers 2, 4. In the three lowest working nips 13–15, the paper web 17 has its other side contacting against the hard rollers 7, 9 so that the desired surface structure, such as smoothness or gloss, is produced on both sides of the paper web.

The direct connection between the calender 1 and the paper machine or coating machine 18 results in an in-line operation. For this reason, each of rollers 2 through 9 has its own drive 21 which allows the paper web 17 to be pulled in during operation. Each of the soft rollers 3, 5, 6 and 8 has an outer covering 22 made of a plastic that is not susceptible to marking. In a preferred embodiment, the plastic is a fiber-reinforced epoxy resin. This material can also be subjected to higher compressive stress and is resistant to higher temperatures than a covering made of fibrous material.

A control device 23 is operatively connected to the calender. For example, the force P with which the upper roller 2 is pressed downward is controlled over a line 24. In a preferred embodiment, the lower roller 9 is held stationary. However, the load can also move in the opposite direction, so that the force P acts on lower roller 9 and the upper roller 2 is fixed. The load determines the compressive stress that is applied in the individual working nips 10–15. The compressive stress increases from the top to the bottom because the weight of the individual rollers is added to the loading force P. However, the differential increase in force in each stack according to the present invention is less than the differential increase in force in each stack of the prior art supercalenders which have from nine to sixteen rollers.

A deflection compensating device 27, 28 is disposed in each hard roller 2, 9, respectively, to adjust the deflection of the upper roller 2 and the lower roller 9, respectively. Control device 23 controls the amount of pressure that is applied along control lines 25, 26, via a pressure device, to the deflection compensating devices 27, 28, respectively, so that the deflection in each roller 2, 9 is adjusted. Deflection devices 27, 28 ensure that there is an even compressive stress applied over the axial length of the roller. Any conventional deflection compensating device can be used. However, it is preferred to use those devices in which support elements are arranged next to each other in a row, which elements can be pressurized individually or in zones at different pressures.

Hard rollers 2, 4, 7, and 9 are heatable, as shown by arrows H. The amount of heat energy that is added is controlled by the control device 23 along control lines 27*a*, 28*a*, 29, 30. The heating may be effected, for example, by electric heating, radiant heating or a heat exchange medium. A protective hood 31 provides heat insulation and ensures that heat that is radiated as a result of the heating is exhausted into the environment to only a slight extent.

The average compressive stress σ applied in at least the lowest working nip 15, and preferably in all of the working nips 10–15, is preferably maintained between 45 and 60 N/mm$^2$ due to force P. The surface temperature of the heatable rollers 2, 4, 7 and 9 is preferably maintained between 100° and 150° C. due to heating H. The diameter of the rollers and the elasticity of the covering 22 are selected so that a nip width of about 2–15 mm, and preferably about 8 mm, is maintained. The dwell times t of the web 17 in each working nip is about 0.1 to 0.9 ms. The dwell time is a function of the web speed. In a preferred embodiment, the temperature T is only slightly above the lower limit, for example 110° C., and the compressive stress is only slightly above the lower limit, for example 50 N/mm$^2$.

The printability of natural and lightly coated papers is not necessarily related to the gloss or smoothness achieved in the paper web, but is instead related to compression or its reciprocal bulk value (in $cm^3/g$). The measurement of printability in photogravure printing is determined by the number of "missing dots" in the quartertone and halftone area. The best results in this regard are obtained when it is ensured that the parameters set forth above are achieved for all working nips.

Figure 2:
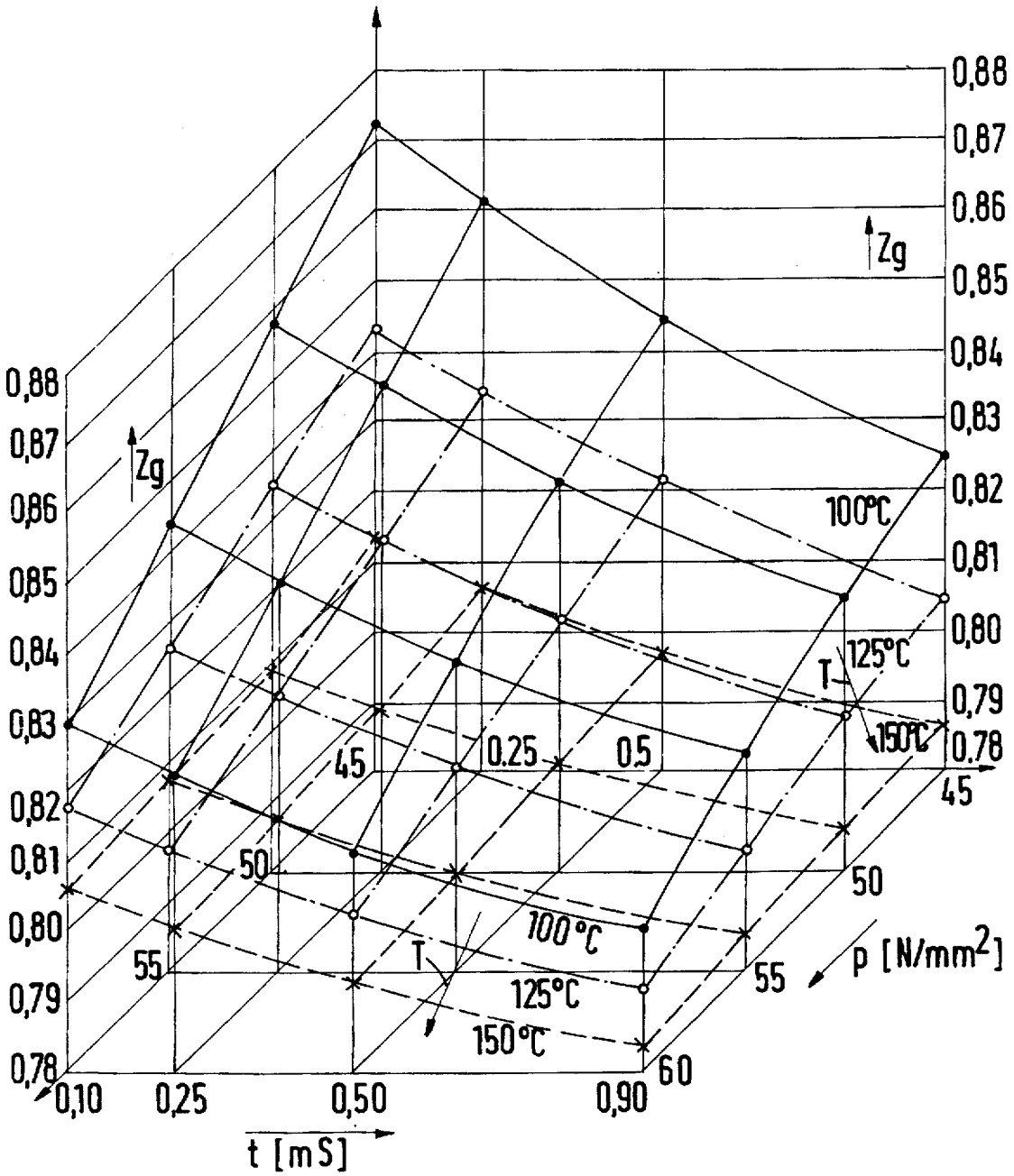
FIG. 2 is a diagram of the dependence of target value Zg on surface temperature T, compressive stress σ, and dwell time t.

Referring to FIG. 2, a three-dimensional diagram is shown in which the target values Zg that correspond to the above relationship (I) are entered, the compressive stress σ (or p in the diagram), in $N/mm^2$, is entered along one axis and the dwell time t, in ms, is entered along the other axis. Three planes of constant temperature T, in °C., are entered; of which the 100° C. plane is shown by solid lines and dots on the grid intersections. The 125° C. plane is shown with dot-and-dash lines with circles at the grid intersections, and the 150° C. plane is shown with dashes and x's at the grid intersections. To arrive at the desired target values, the arithmetic mean of the dwell time t, the surface temperature T and the average compressive stress σ is determined for all six working nips. If those values are related to the diagram shown in FIG. 2, it can immediately be determined whether the target value Zg is in the desired target range between 0.8 and 0.9.

The results of paper treatment can often be improved when the rollers, particularly the middle rollers, are held by levers (not shown), whereby the overhanging weights are preferably compensated for by support devices, as is known from European reference EP 0 285 942 B1.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A calender for treating a paper web, said calender having a roller stack having a first end and a second end, said roller stack being loaded with a load on one end, said calender comprising:

at least two hard rollers each having a substantially smooth outer surface, said at least two hard rollers each having means for heating a surface of said roller to a temperature of at least 100° C.; and at least two soft rollers, wherein each of said at least two soft rollers is disposed adjacent to at least one of said at least two hard rollers to form a working nip therebetween, wherein at least one working nip has a dwell time of said paper web passing through said working nip of at least 0.1 ms, and said load on the rollers produces an average compressive stress in said at least one working nip of at least 42 $N/mm^2$, an arithmetic mean of the numerical value of said surface temperature T, said dwell time t and said compressive stress p in all of said working nips satisfies the following relationship:

$$\text{a target value } Zg=1.378-0.00356\cdot T-(0.00825-5.12\cdot 10^{-5}T)p-[0.039+(0.188-0.00112T)p\cdot e^{-0.093p}]t\cdot e^{-0.42lt}=0.8 \text{ to } 0.9.$$

2. The calender of claim 1, wherein the roller stack comprises eight rollers with a changeover nip formed between two of said at least two soft rollers.

3. The calender of claim 1, wherein at least one end roller is deflection-controllable.

4. The calender of claim 1, wherein for at least one working nip the dwell time is a maximum of 0.9 ms, the heating means produces a maximum surface temperature of 150° C., and the load produces a maximum average compressive stress of 60 $N/mm^2$.

5. The calender of claim 4, wherein at least one of the rollers adjacent to the first end and the second end includes said heating means.

6. The calender of claims 4, wherein said at least two soft rollers include a plastic covering.

7. The calender of claim 6, wherein said plastic covering supports a compressive stress of up to 60 $N/mm^2$.

8. The calender of claim 7, wherein said plastic covering is substantially comprised of a fiber-reinforced epoxy resin.

9. The calender of claim 1, wherein the roller stack is arranged in-line with at least one of a paper machine and a coating machine.

10. The calender of claim 1, wherein each of said at least two hard rollers and said at least two soft rollers are driven independently.

11. The calender of claim 1, wherein the roller stack is covered by a protective hood that reduces heat radiation emitting from said roller stack.

12. A process for operation of a calender for treating a paper web having at least one roller stack, said roller stack being loaded on one end, said calender including at least two hard rollers having a substantially smooth outer surface; and at least two soft rollers, wherein each of said at least two soft rollers is disposed adjacent to at least one of said at least two hard rollers to form a working nip therebetween, whereby a portion of the rollers is heatable and at least one end roller is deflection-controllable, said process comprising the steps of:

selecting the numerical values of the surface temperature T [in °C.], the average compressive stress p [in $N/mm^2$], and the dwell time t [in ms] of all working nips such that the following relationship applies to a target value Zg:

$$Zg=1.378-0.00356\cdot T-(0.00825-5.12\cdot 10^{-5}T)p-[0.039+(0.188-0.00112T)p\cdot e^{-0.093p}]t\cdot e^{-0.42lt}=0.8 \text{ to } 0.9.$$

* * * * *